US010113804B2

(12) United States Patent
Samoto et al.

(10) Patent No.: US 10,113,804 B2
(45) Date of Patent: Oct. 30, 2018

(54) HEAT EXCHANGER AND AIR CONDITIONING DEVICE

(71) Applicant: DENSO CORPORATION, Kariya, Aichi-pref. (JP)

(72) Inventors: Noriyuki Samoto, Takahama (JP); Yasunori Kuno, Chita-gun (JP)

(73) Assignee: DENSO CORPORATION, Kariya, Aighi-pref. (JP)

( * ) Notice: Subject to any disclaimer, the term of this patent is extended or adjusted under 35 U.S.C. 154(b) by 412 days.

(21) Appl. No.: 14/770,201

(22) PCT Filed: Jan. 27, 2014

(86) PCT No.: PCT/JP2014/000388
§ 371 (c)(1),
(2) Date: Aug. 25, 2015

(87) PCT Pub. No.: WO2014/132554
PCT Pub. Date: Sep. 4, 2014

(65) Prior Publication Data

US 2016/0010924 A1 Jan. 14, 2016

(30) Foreign Application Priority Data

Feb. 26, 2013 (JP) ..... 2013-036052

(51) Int. Cl.
*F28F 9/007* (2006.01)
*F28D 7/00* (2006.01)
(Continued)

(52) U.S. Cl.
CPC ..... *F28D 7/0066* (2013.01); *F28D 1/05391* (2013.01); *F28F 9/0204* (2013.01); *F28D 2021/0085* (2013.01); *F28F 2225/08* (2013.01)

(58) Field of Classification Search
CPC ..... F28F 9/001; F28F 9/002; F28F 2225/00
(Continued)

(56) References Cited

U.S. PATENT DOCUMENTS 3,858,291 A * 1/1975 Perpall ..... F02B 29/0456 165/69
5,251,694 A 10/1993 Chigira
(Continued)

FOREIGN PATENT DOCUMENTS

CN 1692265 A 11/2005
JP S61157747 A 7/1986
(Continued)

OTHER PUBLICATIONS

International Search Report and Written Opinion (in Japanese with English Translation) for PCT/JP2014/000388, dated Apr. 1, 2014; ISA/JP.

*Primary Examiner* — Allen Flanigan
(74) *Attorney, Agent, or Firm* — Harness, Dickey & Pierce, P.L.C.

(57) ABSTRACT

A heat exchanger includes: a core part having tubes in which refrigerant flows; a pair of tank parts extending to intersect the tubes in an intersection direction at longitudinal ends of the tubes to distribute fluid to the tubes and to gather fluid flowing inside the tubes; an inner wall part arranged in the pair of tank parts to change a flow of the refrigerant in the tank part; and a reinforcement part that partially reinforces an outer periphery part of the pair of tank parts from the outer side. The reinforcement part is located at a position except both ends of the pair of tank parts in the intersection direction and except an outer periphery part of the tank part that is on an outer side of the inner wall part.

8 Claims, 7 Drawing Sheets

(51) Int. Cl.
*F28F 9/02* (2006.01)
*F28D 1/053* (2006.01)
*F28D 21/00* (2006.01)

(58) Field of Classification Search
USPC ..... 165/67; 180/68.4
See application file for complete search history.

(56) References Cited

U.S. PATENT DOCUMENTS 5,329,990 A 7/1994 Chigira
5,373,896 A 12/1994 Osborn
5,570,737 A * 11/1996 Tokutake ..... F28D 1/0535 165/67
5,944,096 A * 8/1999 Hubert ..... F28F 9/0224 165/173
6,598,411 B2 * 7/2003 Nomura ..... B60H 1/00521 62/239
7,243,751 B2 * 7/2007 Shigematsu ..... B60K 11/04 180/68.4
2001/0004010 A1 * 6/2001 Halm ..... F28F 9/002 165/67
2003/0230397 A1 * 12/2003 Southwick ..... B60K 11/04 165/67
2005/0172664 A1 8/2005 Cho et al.
2011/0061853 A1 * 3/2011 Kaiyama ..... B60H 1/00321 165/254

FOREIGN PATENT DOCUMENTS

JP H0462393 A 2/1992
JP H06344766 A 12/1994
JP 2005003264 A 1/2005
JP 2006335189 A 12/2006
JP 2007170715 A 7/2007
WO WO-2014083754 A1 6/2014

* cited by examiner

HEAT EXCHANGER AND AIR CONDITIONING DEVICE

CROSS REFERENCE TO RELATED APPLICATIONS

This application is a U.S. National Phase Application under 35 U.S.C. 371 of International Application No. PCT/JP2014/000388 filed on Jan. 27, 2014 and published in Japanese as WO 2014/132554 A1 on Sep. 4, 2014. This application is based on and claims the benefit of priority from Japanese Patent Application No. 2013-036052 filed on Feb. 26, 2013. The entire disclosures of all of the above applications are incorporated herein by reference.

TECHNICAL FIELD

The present disclosure relates to a heat exchanger in which refrigerant flows, and an air conditioning device including a heat exchanger inside an air-conditioning case.

BACKGROUND ART

A cooling evaporator of an air-conditioning unit for a vehicle described in Patent Literature 1 is assembled into a case of the air-conditioning unit through elastic component at four corners of the evaporator. The elastic component absorbs vibration of the evaporator. Specifically, the evaporator is combined to a compressor in an engine compartment of the vehicle through a refrigerant piping. The compressor is mounted to and driven with an engine of the vehicle. Therefore, the compressor vibrates integrally with the engine. Moreover, the compressor itself vibrates by pulsation generated when the compressor draws and discharges refrigerant. The vibration of the compressor is transmitted to the evaporator located in the vehicle interior through the refrigerant piping. Moreover, an expansion valve and the piping vibrate when refrigerant flows, and this vibration is transmitted to the evaporator. Furthermore, the evaporator itself vibrates with the refrigerant passing inside of the evaporator. The evaporator is supported by the elastic component to absorb vibration transmitted to the evaporator and the own vibration of the evaporator, so as to restrict abnormal noise produced by amplifying the vibration of the evaporator that is transmitted to the case of the air-conditioning unit.

PRIOR ART LITERATURES

Patent Literature

Patent Literature 1: JP 2006-335189A

SUMMARY OF INVENTION

In Patent Literature 1, although the elastic component is placed at the four corners, since the elastic component is incorporated to the case of the evaporator, the number of components for producing the evaporator increases. The number of processes for manufacturing the evaporator increases, so the productivity falls.

The present disclosure is aimed to provide a heat exchanger and an air conditioning device in which the vibration transmission to the exterior can be reduced with the simple configuration.

According to an aspect of the present disclosure, a heat exchanger includes a core part, a pair of tank parts, an inner wall part and a reinforcement part. The core part has a plurality of tubes in which refrigerant flows. The pair of tank parts extends in an intersection direction to intersect the tubes, at longitudinal ends of the tubes to distribute fluid to the tubes and to gather fluid flowing inside the tubes. The inner wall part is arranged in the pair of tank parts to change a flow of the refrigerant in the tank parts. The reinforcement part partially reinforces an outer periphery part of the pair of tank parts from outer side. The reinforcement part is located at a position except both ends of the pair of tank parts in the intersection direction and except an outer periphery part of the tank part that is on an outer side of the inner wall part.

Thereby, the reinforcement part is prepared at the position except the both ends of the pair of tank parts and except the outer periphery part of the tank part that is on the outer side of the inner wall part. The both ends and a portion of the tank part at which the inner wall part is arranged have high rigidity, in which the vibration is small. The reinforcement part partially reinforces the other portion to raise the rigidity, so vibration can be restricted at the other portion where the rigidity is low. Therefore, the sound caused by the refrigerant flow in the heat exchanger can be reduced. Moreover, the size and weight of the tank part can be restricted from increasing by the partial reinforcing in the present disclosure, while the size and weight of the tank part is increased if the whole structure is reinforced. Therefore, vibration can be effectively controlled with the easy configuration.

According to an aspect of the present disclosure, an air conditioning device includes: an air-conditioning case through which air passes; and a heat exchanger arranged in the air-conditioning case. The heat exchanger includes: a core part having a plurality of tubes in which refrigerant flows; a pair of tank parts extending in an intersection direction to intersect the tubes, at longitudinal ends of the tubes to distribute fluid to the tubes and to gather fluid flowing inside the tubes; and an inner wall part arranged in the pair of tank parts to change a flow of the refrigerant in the tank parts. The air-conditioning case includes a reinforcement part that partially reinforces the air-conditioning case. The air-conditioning case is in contact with an outer periphery part of the pair of tank parts to fix the heat exchanger. The reinforcement part is located at a position except both ends of the pair of tank parts in the intersection direction and except an outer periphery part of the tank part that is on an outer side of the inner wall part.

DESCRIPTION OF EMBODIMENTS

Figure 1:
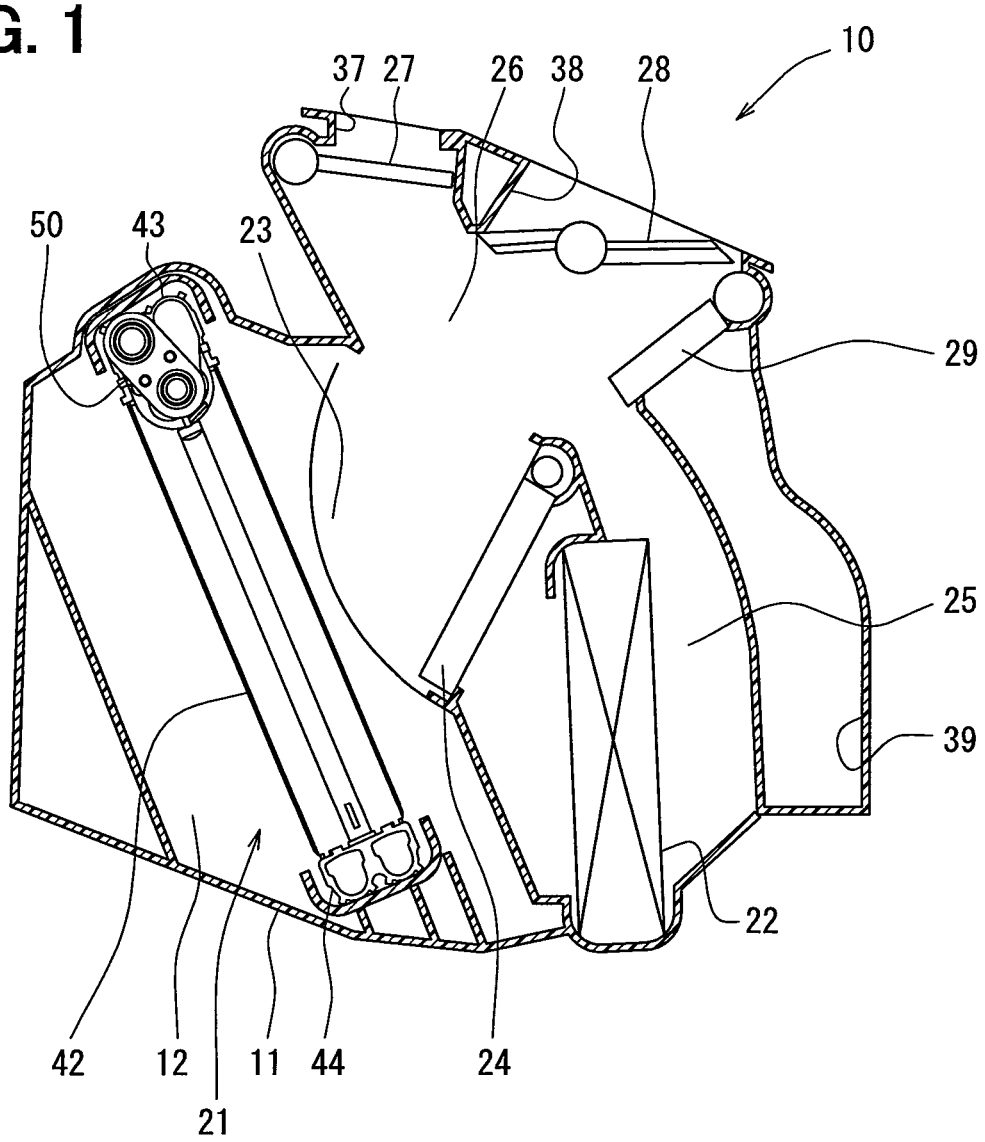
FIG. 1 is a schematic sectional view illustrating an air-conditioner for a vehicle according to a first embodiment.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

(First Embodiment)

A first embodiment of the present disclosure is described with reference to FIG. 1 to FIG. 7. An air-conditioner 10 for a vehicle is able to perform air-conditioning operation for a passenger compartment of the vehicle. The outer shape of the air-conditioner 10 is defined by an air-conditioning case 11, and the air-conditioner 10 is equipped with a ventilation part and an air-conditioning part. The air-conditioning case 11 is arranged on the back side of an instrument panel (not shown) ahead in the vehicle interior. Plural passages are defined in the air-conditioning case 11, through which air flows, and the flow of air is branched into the passages or joins from the passages. The air-conditioning case 11 consists of multiple case components, and may be resin-molded product such as polypropylene. The multiple case components are assembled by a fastening member such as metal spring and screw into one-piece forming the air-conditioning case 11.

The ventilation part is equipped with a blower (not shown) for ventilating air to the air-conditioning part from the vehicle interior or outside of the vehicle. The blow-off port of the blower is connected with a ventilation passage 12 extending to the inlet of the air-conditioning part. The blower includes a centrifugal multi-blade fan and a motor which drives the centrifugal multi-blade fan. The circumference of the centrifugal multi-blade fan is surrounded by a scroll casing. A duct extended in the radial direction of the centrifugal multi-blade fan connects the blower to the ventilation passage 12.

The air-conditioning part has an evaporator 21 provided to cover across whole of the ventilation passage 12, a heater core 22 which heats air passing through the evaporator 21, a cool air passage 23, an air mixing door 24, a warm air passage 25, an air mix chamber 26 where the cool air and the warm air are mixed, a door 27 for defroster, a door 28 for face, and a door 29 for foot, inside of the air-conditioning case 11. Plural blow-off ports such as a defroster blow-off port 37, a face blow-off port 38, and a foot blow-off port 39 are formed in the air-conditioning case 11 at the downstream of the cool air passage 23 and the warm air passage 25.

The defroster blow-off port 37 is located at the upper part of the vehicle front side of the air-conditioning case 11. A defroster indoor blow-off port (not shown) which is one of indoor blow-off ports is prepared at the vehicle front side of the instrument panel near the front windshield. The defroster blow-off port 37 and the defroster indoor blow-off port are connected by a duct for defroster (not shown) such that conditioned-air flows along the inner surface of the front windshield, in order to reduce the fog. The defroster blow-off port 37 is opened and closed by the door 27 for defroster.

The face blow-off port 38 is located on the vehicle rear side of the defroster blow-off port 37 at the upper part of the air-conditioning case 11. A face indoor blow-off port (not shown) which is one of indoor blow-off ports exposed to the vehicle interior is prepared at the front of the instrument panel on the vehicle rear side. The face blow-off port 38 and the face indoor blow-off port are connected by a duct for face (not shown) to blow off conditioned-air toward the upper half body of an occupant seated on a driver seat and a passenger seat. The face blow-off port 38 is opened and closed by the door 28 for face.

The foot blow-off port 39 is located at the lower side of the face blow-off port 38 that is at the upper part of the air-conditioning case 11. A foot indoor blow-off port (not shown) which is one of the indoor blow-off ports is prepared around a foot of an occupant. The foot blow-off port 39 and the foot indoor blow-off port are connected by a duct for foot (not shown) to blow off conditioned-air toward the foot of the occupant seated on the driver seat and the passenger seat. The foot blow-off port 39 is opened and closed by the door 29 for foot.

Each of the door 27 for defroster, the door 28 for face, and the door 29 for foot is a tabular door having a plate-shaped door board and a rotation shaft. The blower, the air mixing door 24, the door 27 for defroster, the door 28 for face, and the door 29 for foot are controlled by a control device which is not illustrated.

The evaporator 21 is a heat exchanger for cooling, for example, located at the vehicle front side of the air-conditioning case 11, and receives air sent by the blower to evaporate refrigerant with low-temperature and low-pressure decompressed by an expansion valve in a refrigerating cycle. The sent air passing around the tube 41 in which refrigerant flows is cooled and supplied to the cool air passage 23 located on the downstream.

The heater core 22 is a heat exchanger for heating, for example, located on the vehicle rear side of the evaporator 21 at the lower part, and heats air flowing around the heater core by heat exchange between the sent air and cooling water with high-temperature for the engine corresponding to a heat source. The heater core 22 is arranged to partially cover the passage downstream of the evaporator 21 in the air flow direction.

The air mixing door 24 adjusts the ratio of the amount of the warm air passing through the heater core 22 and the amount of the cool air not passing through the heater core 22 by controlling the opening degree position, to perform temperature control of the conditioned-air. When the air mixing door 24 is at the position shown in FIG. 1, the maximum cooling operation is performed. The warm air passage 25 is shut to completely intercept the flow of the air to the heater core 22, and the vehicle interior is provided with the cooled air.

When the air mixing door 24 is at a middle position, both the cool air passage 23 and the warm air passage 25 are partially opened, and both of warm air and cool air flow to the downstream side. Then, warm air and cool air are mixed in the air mix chamber 26 upstream of each blow-off port, and the conditioned air is blown off from the blow-off port that is opened and sent to the indoor blow-off port through the duct.

Figure 2:
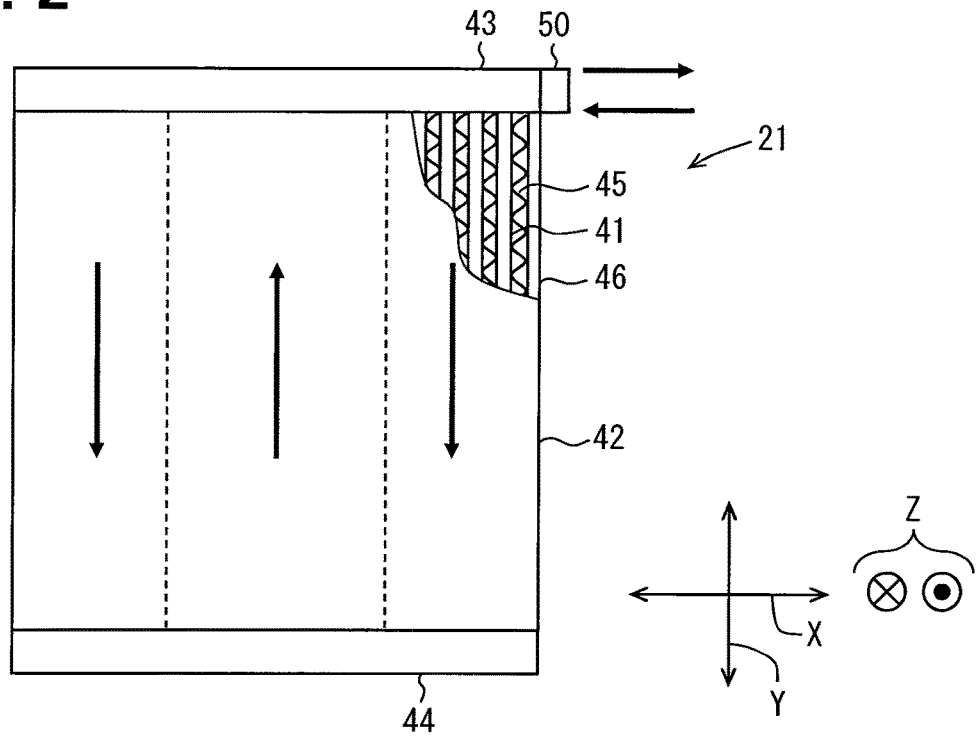
FIG. 2 is a schematic front view illustrating an evaporator of the first embodiment.

Next, the evaporator 21 is explained with reference to FIG. 2 to FIG. 4. As shown in FIG. 2, the evaporator 21 includes a core part 42, an upper tank part 43 and a lower tank part 44 that correspond to a pair of tank parts 43, 44, which are connected to each other by brazing.

The core part 42 include plural flat tubes 41 and plural corrugated fins 45 alternately stacked with each other in the stacking direction (the direction of X). A side plate 46 is arranged on the most outer side of the corrugated fin 45 on the both-sides in the stacking direction. Refrigerant which is internal fluid of the core part 42 flows along the longitudinal direction (the direction of Y) of the flat tube 41. The refrigerant flow direction is defined as a width direction Y of the evaporator 21. The air flow direction in the core part 42 is defined as a thickness direction Z of the evaporator 21. A direction (the stacking direction X) perpendicular to the width direction Y and the thickness direction Z is defined as a longitudinal direction of the evaporator 21. The evaporator 21 is arranged at the vehicle by setting the width direction Y to correspond to the up-and-down direction.

The flat tube 41 is a pipe component formed by bending and processing a band-shaped board material made of aluminum with thin thickness. In the cross section perpendicular to the refrigerant flow direction, the flat tube 41 has the flat shape. The flat tube 41 may be formed by extrusion fabrication of aluminum material to integrally provide plural refrigerant passages extending in the longitudinal direction. Alternatively, two metal thin boards made from aluminum may be set to oppose to each other to define a hollow shape and joined to each other. The board thickness of the flat tube 41 is, for example, 0.2 mm.

The corrugated fin 45 is formed by roller processing of a thin board material made from aluminum to which wax material is clad in advance to the both sides, so as to have a meandering (wave) shape. The corrugated fin 45 has plural louvers (not shown) for raising the heat exchange efficiency. The board thickness of the corrugated fin 45 is, for example, 0.05 mm.

The side plate 46 reinforces the core part 42, and is fabricated by press processing of a plate material made from aluminum that is a bare material to which no wax material is clad. The both end portions of the side plate 46 in the longitudinal direction (width direction Y) are formed in the plate shape. The central portion of the side plate 46 is formed to have U-shaped cross-section open outward in the stacking direction X of the flat tube 41 and the corrugated fin 45. The side plate 46 is brazed to the corrugated fin 45. The board thickness of the side plate 46 is, for example, 1 mm.

The pair of tank parts 43, 44 extends in an intersection direction (the stacking direction X) to intersect the flat tube 41, and is placed at the both ends of the flat tube 41 in the longitudinal direction Y. The pair of tank parts 43, 44 distributes fluid to the flat tubes 41, and gathers the fluid from the flat tubes 41.

First, the upper tank part 43 is explained, of the pair of tank parts 43, 44. The upper tank part 43 has a header plate (not shown) adjacent to the flat tube 41 and a header tank (not shown) away from the flat tube 41, which are arranged in the longitudinal direction Y of the flat tube 41. The header tank and the header plate respectively have the shape of semi-circle and the shape of rectangle in the cross-section, and are fabricated by press processing of a plate material made from aluminum.

The wax material is clad in advance to both sides of the header tank and the inner surface of the header plate. The header tank and the header plate are fitted mutually and brazed, to form a cylindrical object (refer to FIG. 7) in which two interior spaces are arranged in the air flow direction (the thickness direction Z of the evaporator 21). A cap fabricated by press processing a plate material made from aluminum is brazed to the longitudinal end opening of the upper tank part 43 (both ends in the stacking direction X) to close and cover the opening. The board thickness of the upper tank part 43 and the lower tank part 44 is 1 mm, for example.

Two separators 47 are brazed to the upper tank part 43 to divide the interior space in the longitudinal direction of the upper tank part 43 (the stacking direction X). As shown in FIG. 3, plural communicate passages 48 are defined between the two interior spaces of the upper tank part 43 arranged in the air flow direction, so as to mutually communicate, in the left area of the separator 47 in the upper tank part 43.

The lower tank part 44 has a structure similar to the upper tank part 43, and forms the cylindrical object with the header tank and the header plate. A cap is prepared at the both end openings in the longitudinal direction. One separator 47 is similarly brazed to the lower tank part 44. As shown in FIG. 4, plural communicate passages 48 are defined between the two interior spaces of the lower tank part 44 arranged in the air flow direction, so as to mutually communicate, in the left area of the separator 47 in the lower tank part 44. Furthermore, three choke portions 49 are formed inside of the lower tank part 44 to perform adiabatic expansion of refrigerant.

A wall surface of the pair of tank parts 43, 44 adjacent to the core part 42 (a wall surface of a header plate) has a flat tube loading slot which is not illustrated and a side plate loading slot which is not illustrated in the stacking direction X with the same pitch as the pitch of the flat tube 41 and the side plate 46. The end of each flat tube 41 in the longitudinal direction Y and the end of the side plate 46 in the longitudinal direction Y are inserted and brazed to the flat tube loading slot and the side plate loading slot respectively. Thereby, the interior spaces of the pair of tank parts 43 and 44 communicate to each other through the flat tube 41, and the longitudinal end of the side plate 46 is supported and fixed to the pair of tank parts 43, 44.

A connecting block (refrigerant out/in port) 50 is brazed to the right end of the upper tank part 43 shown in FIG. 2, and has an inflow port from which refrigerant flows in and an outflow port from which refrigerant flows out. The inflow port communicates to one (lower side in FIG. 3) of the interior spaces of the upper tank part 43 arranged in the air flow, and the outlet port communicates to the other (upper side in FIG. 3) of the interior spaces of the upper tank part 43 arranged in the air flow.

The flat tube 41 is arranged in two rows in the flow direction of air which is external fluid to correspond to the arrangement in the pair of tank parts 43, 44. The windward row of the flat tubes 41 and the leeward row of the flat tube 41 are arranged in the air flow. In the evaporator 21 formed in this way, after refrigerant flows into one space of the upper tank part 43 from the inflow port, refrigerant flows through one of rows of the flat tubes 41 and one space of the lower tank part 44 by moving in zigzag up and down, and reaches the left end of the upper tank part 43 shown in FIG. 1. Then, refrigerant passes through the communicate passage 48 from the one space of the upper tank part 43 into the other space, and passes through the other row of the flat tubes 41 and the other space of the lower tank part 44 by moving in zigzag up and down in a similar manner, and returns to the other space of the upper tank part 43. Finally, refrigerant flows out of the outflow port. Meanwhile, the evaporator 21 evaporates refrigerant to cool air by the evaporation latent heat.

Figure 5:
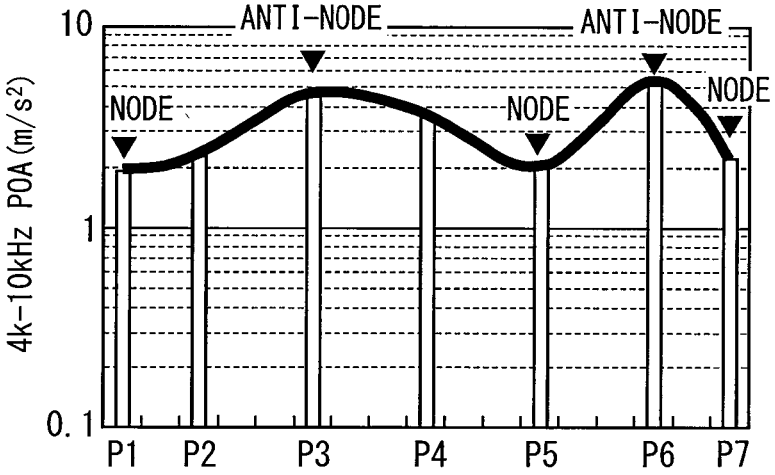
FIG. 5 is a graph illustrating vibration characteristic of an upper tank part of the evaporator of the first embodiment.
Figure 6:
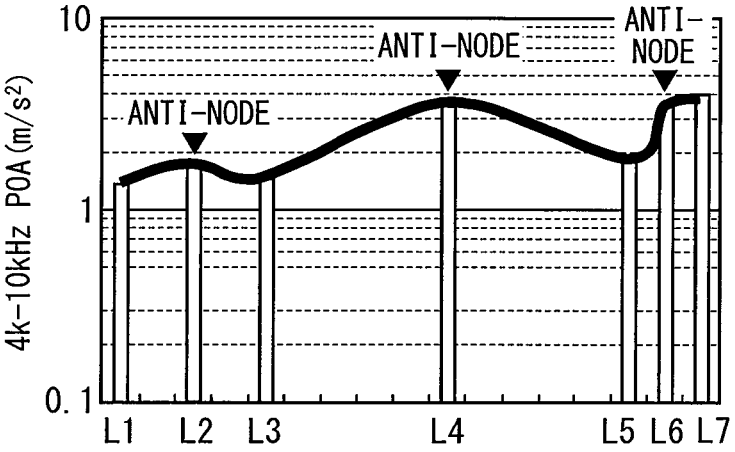
FIG. 6 is a graph illustrating vibration characteristic of a lower tank part of the evaporator of the first embodiment.

Next, the vibration restricting structure of the evaporator 21 is explained with reference to FIG. 5 to FIG. 7. The evaporator 21 is fixed in the air-conditioning case 11 of the air-conditioner 10 for a vehicle. In FIG. 5 and FIG. 6, a vertical axis represents a Partial Over All value (=POA value). First, vibration is applied as a vibration-apply force by making refrigerant to flow in the evaporator 21 to obtain the POA value. At this time, the vibration-apply force is measured with a power converter, and the response is measured with an accelerometer. Next, the vibration-apply force and the acceleration response are detected, and a frequency response function is obtained, such that the POA value can be calculated from the frequency response function. The frequency range shown in FIG. 5 and FIG. 6 is 4 kHz to 10 kHz.

Figure 3:
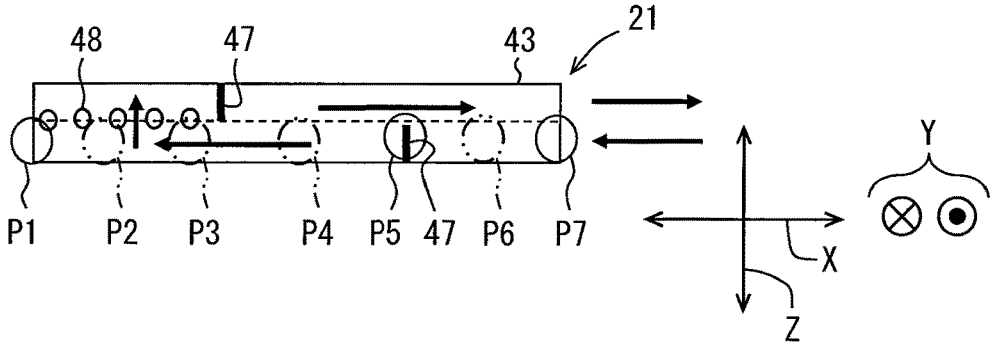
FIG. 3 is a schematic plan view illustrating the evaporator of the first embodiment.
Figure 4:
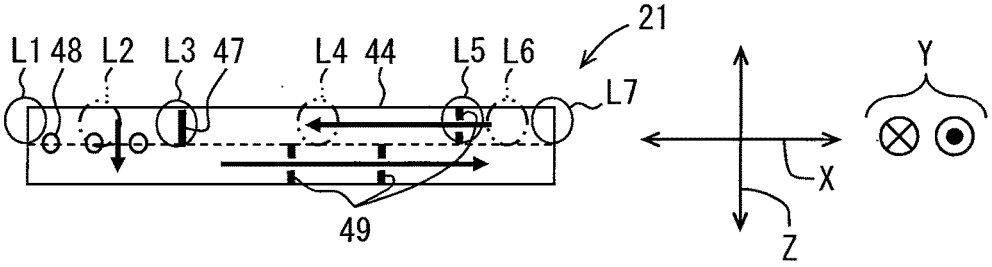
FIG. 4 is a schematic bottom view illustrating the evaporator of the first embodiment.

The detecting points P1-P7 of FIG. 5 correspond to the circles P1-P7 of FIG. 3 respectively. The detecting points L1-L7 of FIG. 6 correspond to the circles L1-L7 of FIG. 4 respectively. The circle in a solid line in FIG. 3 and FIG. 4 represents a portion with high rigidity in each of the tank parts 43 and 44. Therefore, the circle in the solid line is given to the both ends of tank part 43, 44, the position of the separator 47, and the position of the choke portion 49. The circle in a virtual line shown in FIG. 3 and FIG. 4 is a detecting point other than the detecting point shown in the solid line. As shown in FIG. 5 and FIG. 6, the POA value is comparatively small at the position (P1, P5, P7, L1, L3, L5, L7) shown in the solid line. Hereafter, the place where the POA value is large may be referred to an antinode, and the place where the POA value is small may be referred to a node.

Since vibration is larger at the antinode than at the node, the radiation sound of the evaporator 21 may be caused. So, in this embodiment, the evaporator 21 is fixed to the air-conditioning case 11 to raise the rigidity at the antinode where the vibration of the upper tank part 43 and the lower tank part 44 is large. Specifically, when the evaporator 21 is fixed to the air-conditioning case 11, the outer periphery part of the pair of tank parts 43, 44 and the inner wall of the air-conditioning case 11 are in contact with each other. Of the contact positions at which the inner wall of the air-conditioning case 11 and the outer periphery part of the upper tank part 43 are in contact with each other, at least one position corresponds to the reinforcement part 60 of the air-conditioning case 11. The reinforcement part 60 partially reinforces the air-conditioning case 11. The reinforcement part 60 is formed on the outer wall of the air-conditioning case 11, as shown in FIG. 7, and is realized by a rib 60 for reinforcement extending in the left-and-right direction of FIG. 7.

Figure 7:
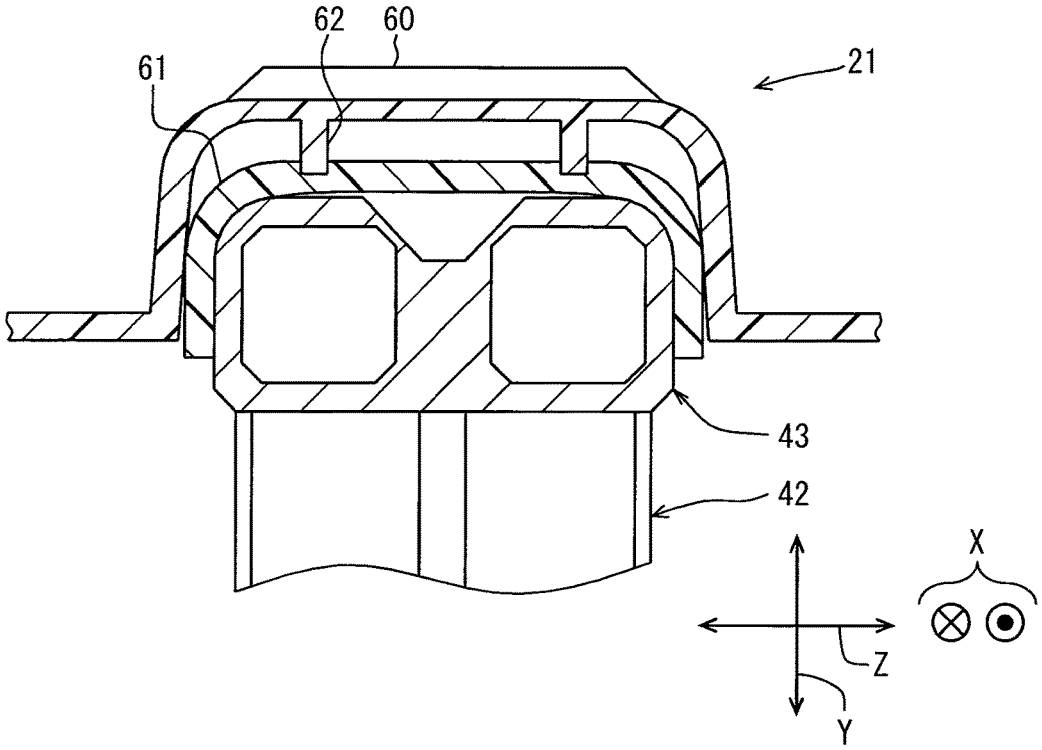
FIG. 7 is a schematic enlarged sectional view illustrating an air-conditioning case and the upper tank part of the first embodiment.

As shown in FIG. 7, a gasket 61 is disposed between the upper tank part 43 and the inner wall of the air-conditioning case 11. The gasket 61 is provided to prevent air leak between the air-conditioning case 11 and the evaporator 21. The gasket 61 is a part of the inner wall of the air-conditioning case 11. Moreover, a rib 62 for positioning is arranged between the inner wall of the air-conditioning case 11 and the gasket 61. The rib 62 for positioning extends in the stacking direction X. As is clearly shown in FIG. 7, the rib 62 extends inwardly from the inner wall of the air-conditioning case and engages the outer periphery part of a tank part, so as to space the inner wall of the air-conditioning case from the outer periphery of the corresponding tank part.

The rib 60 for reinforcement is arranged at plural positions with an interval in the stacking direction X. In this embodiment, the reinforcement part 60 is located at center between the separator 47 or the choke portion 49 and the both ends of the tank parts 43, 44 adjacent to each other in the stacking direction X. Specifically, in the upper tank part 43, the rib 60 for reinforcement is located at the positions opposing P3 and P6. The position of P3 is located at the center between the left end of the upper tank part 43 and the separator 47. Such position at center between the fixed ends easily serves as an antinode. Similarly, the position of P6 is located at the center between the right end of the upper tank part 43 and the separator 47.

The lower tank part 44 is fixed similarly and the rib 60 for reinforcement is located at the positions opposing L2, L4, and L6. The position of L2 is located at the center between the left end of the lower tank part 44 and the separator 47. The position of L4 is located at the center between the separator 47 and the choke portion 49. The position of L6 is located at the center between the right end of the lower tank part 44 and the separator 47. The rib 60 for reinforcement raises the rigidity compared with a portion without the rib 60 for reinforcement. Therefore, the portion with the rib 60 for reinforcement does not vibrate easily.

As explained above, the evaporator 21 of this embodiment has the reinforcement part 60 at the position except the both ends of the pair of tank parts 43, 44 and the outer periphery part of the tank parts 43, 44 on the outer side of the separator 47 and the choke portion 49. The rigidity is high at the both ends and a portion of the tank parts 43, 44 where the separator 47 and the choke portion 49 are defined, so the vibration is small. The other portion is partially reinforced by the reinforcement part 60 to raise the rigidity, such that vibration can be restricted at the other portion where the rigidity is low. Therefore, the noise sound resulting from the refrigerant flow and emitted from the evaporator 21 can be reduced. If the whole structure is reinforced, the size and weight is increased in the tank parts 43, 44. However, the size and weight of the tank parts 43, 44 is restricted from increasing by the partial reinforcing in the evaporator 21. Therefore, vibration can be effectively controlled with the simple configuration.

The reinforcement part 60 of the air-conditioning case 11 is provided at the position corresponding to the antinode of the vibration mode of the evaporator 21 in the state where the evaporator 21 is fixed to the air-conditioning case 11. In this embodiment, the POA value is the maximum at the position corresponding to the antinode, and the POA value is the minimum at the position corresponding to the node. The position corresponding to the antinode is a position including the position of the antinode and the adjacent position adjacent to the antinode. The position corresponding to the antinode may be ranged, for example, from the center where the POA value is the maximum to a position where the POA value is larger than a predetermined threshold. The threshold is set in advance to achieve the above-mentioned vibration control effect. Moreover, the position corresponding to the antinode may be set by, for example, ¼ or less of the area from the antinode (maximum) to the node, in the POA value, as a threshold. At such an antinode position, vibration becomes large in the range more than or equal to the predetermined threshold relative to the antinode (maximum value). Such an antinode position is partially reinforce by the reinforcement part 60 of the air-conditioning case 11 to raise the rigidity, such that vibration can be restricted at the antinode. Therefore, the sound resulting from the refrigerant flow and emitted from the evaporator 21 can be reduced.

In this embodiment, an inner wall part such as the separator 47 and the choke portion 49 for changing the flow of refrigerant is prepared in the pair of tank parts 43, 44. The reinforcement part 60 is formed at the position except the both ends of the pair of tank parts 43, 44 in the stacking direction X and except the outer periphery part of the inner wall part. Vibration easily becomes small at the portion having the inner wall part, because the reinforcing is achieved by the inner wall part. The reinforcement part 60 is arranged at the position, to raise the vibration control effect, excluding the portion having the inner wall part, such that the vibration control effect can be heightened.

Furthermore, in this embodiment, the rib 60 for reinforcement is provided in the air-conditioning case 11 to extend in the thickness direction of the evaporator 21. The moment of inertia of area becomes large, due to the rib 60 for reinforcement, in the cross-section including the thickness direction Z and the longitudinal direction Y of the flat tube 41. Therefore, vibration can be effectively controlled by the reinforcement part 60 having the simple shape.

In other words, in the present embodiment, the rigidity is raised at the portion where the vibration of the evaporator 21 is large, while sound is emitted from the evaporator 21 when refrigerant flows in the evaporator 21, such that the vibration is reduced to restrict the noise. Specifically, the pair of tank parts 43, 44 is locally pressed by the rib 60 for reinforcement. If the rigidity is raised in whole of the tank part or whole of the air-conditioning case 11, it is necessary to increase the pressing force and the size of the component. In this case, the sound becomes large since the vibration is transmitted to the air-conditioning case 11 as it is, and the cost is increased by changing the material to raise the strength of the tank part. Therefore, it is desirable to locally press using the reinforcement part 60 in this embodiment.

Conventionally, a damping material such as isobutylene-isoprene rubber is mounted to the tank part to reduce the vibration, but the weight of the vehicle is increased by the damping material and the fuel consumption is increased. However, according to the present embodiment, the rigidity is locally raised, in the frequency range of 4 kHz to 10 kHz of sound emitted directly from the evaporator, at the position where the vibration becomes large, that is except the corner of the tank part 43, 44, the separator 47, and the choke portion 49. Specifically, the rib 60 for reinforcement locally holds the pair of tank parts 43, 44, thereby reducing the direct radiation sound from the evaporator 21 and raising the rigidity of the air-conditioning case 11 adjacent to the rib 60 for reinforcement. Thus, the vibration propagation from the pair of tank parts 43, 44 to the air-conditioning case 11 is made small to reduce the radiation sound.

(Second Embodiment)

A second embodiment of the present disclosure is described with reference to FIG. 8 to FIG. 12. In this embodiment, the position and number of the separator 47 and the choke portion 49 in the pair of tank parts 43, 44 is modified from the first embodiment. In other words, the flow of refrigerant in the core part 42 is different in this embodiment compared with the first embodiment.

Figure 8:
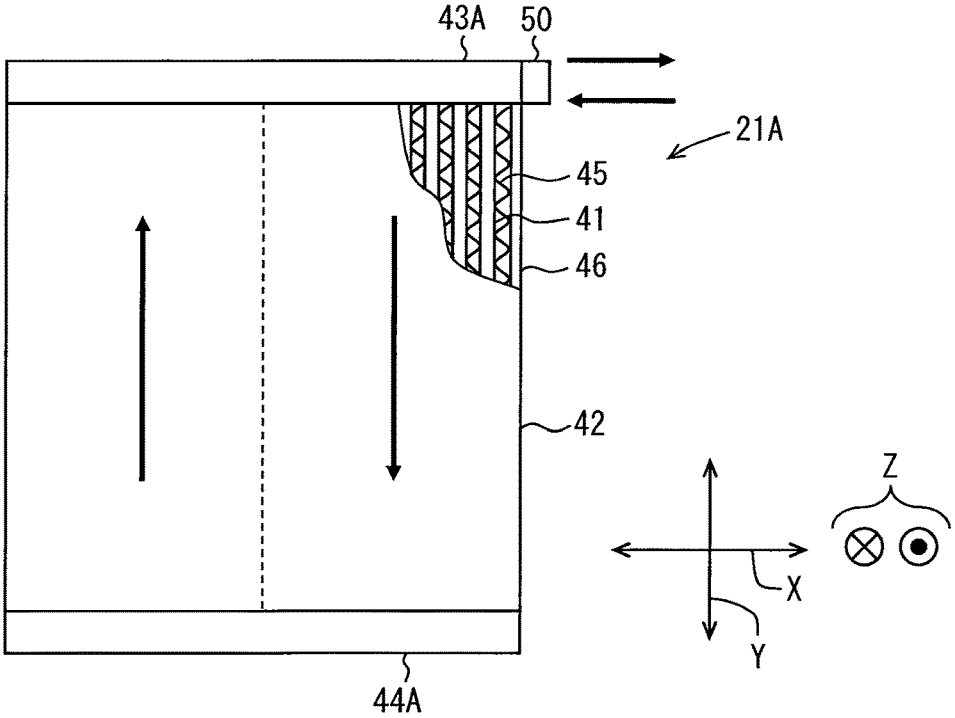
FIG. 8 is a schematic front view illustrating an evaporator according to a second embodiment.
Figure 9:
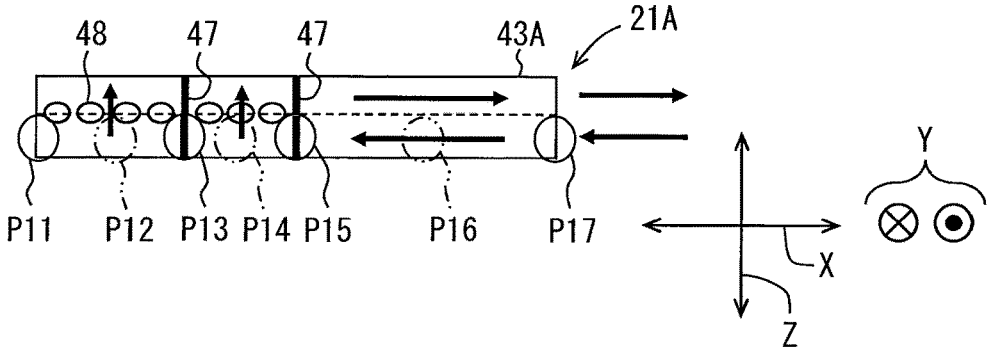
FIG. 9 is a schematic plan view illustrating the evaporator of the second embodiment.
Figure 10:
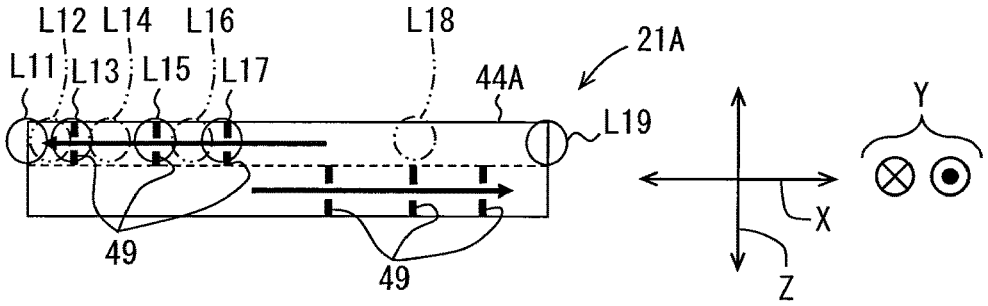
FIG. 10 is a schematic bottom view illustrating the evaporator of the second embodiment.

As shown in FIG. 9, four separators 47 are brazed to the upper tank part 43A. As shown in FIG. 10, six choke portions 49 are brazed to the lower tank part 44A. Refrigerant flows to make U-turn, due to the arrangement of the separators 47 and the choke portions 49, as shown in FIG. 8, when seen as whole of the core part 42.

Figure 11:
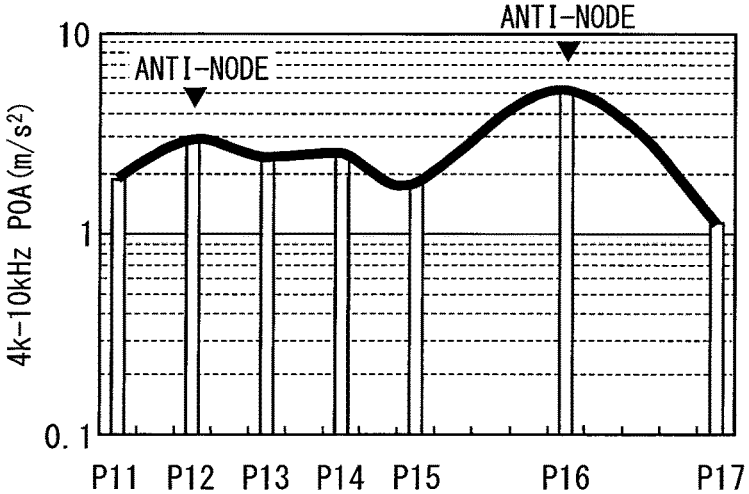
FIG. 11 is a graph illustrating vibration characteristic of an upper tank part of the evaporator of the second embodiment.
Figure 12:
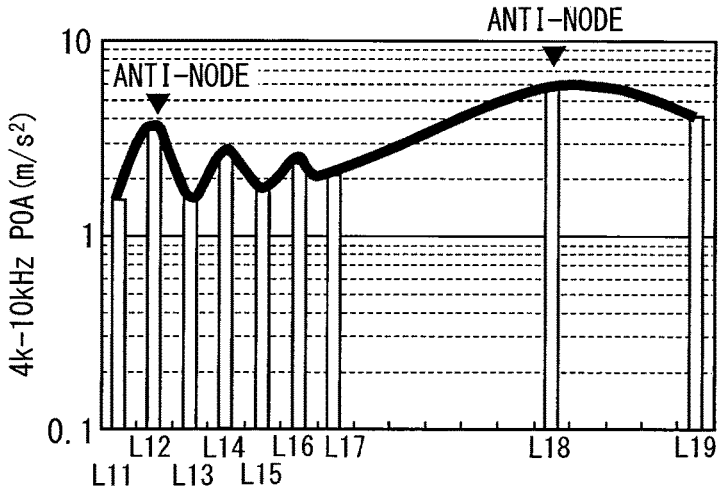
FIG. 12 is a graph illustrating vibration characteristic of a lower tank part of the evaporator of the second embodiment.

The detecting points P11-P17 of FIG. 11 correspond to the circles P11-P17 of FIG. 9 respectively. The detecting points L11-L19 of FIG. 12 correspond to the circles L11-L19 of FIG. 10 respectively. The circle in a solid line shown in FIG. 9 and FIG. 10 represents a portion with high rigidity in each of the tank parts 43A and 44A. The circle in the solid line is given to the both ends of each tank part 43A, 44A, the position of the separator 47, and the position of the choke portion 49. The circle in a virtual line shown in FIG. 9 and FIG. 10 is a detecting point other than the detecting point shown in the solid line. As shown in FIG. 9 and FIG. 10, the POA value is comparatively small at the position (P11, P13, P15, P17, L11, L13, L15, L17) shown in the solid line.

The rib 60 for reinforcement is disposed at the position opposing P12 and P16 in the upper tank part 43A in this embodiment. Moreover, the lower tank part 44A is fixed similarly, and the rib 60 for reinforcement is disposed at the position opposing L12 and L18. Therefore, in the lower tank part 44A, the rib 60 for reinforcement is formed not all the positions opposing the antinode. The rib 60 for reinforcement is provided at the position opposing the antinode where the POA value is comparatively high.

When the position of the separator 47 and the choke portion 49 is different in the tank part 43A, 44A, the POA value of the tank part 43A, 44A differs. The position of the rib 60 for reinforcement is changed according to the position of the antinode, thereby achieving the same action and effect as the first embodiment for the evaporator 21 in this embodiment.

(Third Embodiment)

Figure 13:
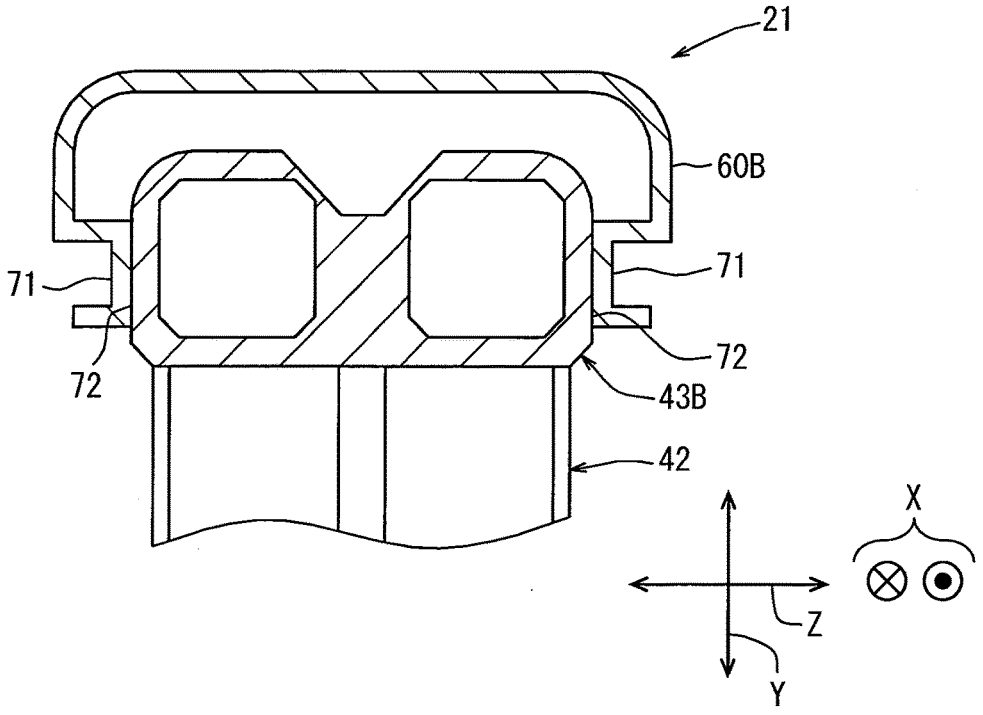
FIG. 13 is a schematic enlarged sectional view illustrating an upper tank part of an evaporator according to a third embodiment.
Figure 14:
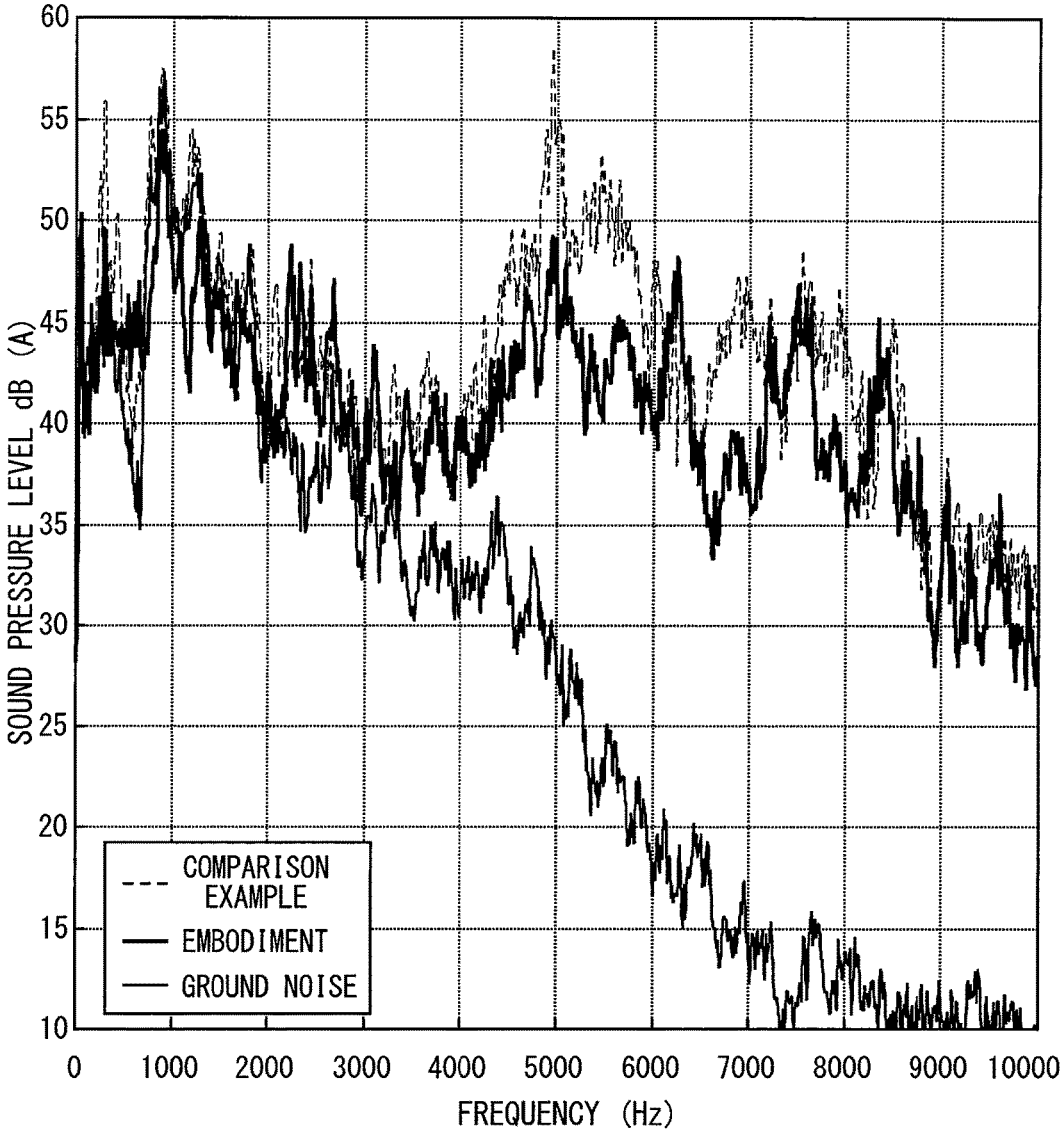
FIG. 14 is a graph illustrating a relationship between frequency and sound pressure level in the third embodiment in contrast to a comparative example.

A third embodiment of the present disclosure is described with reference to FIG. 13 and FIG. 14. In this embodiment, the configuration of the reinforcement part 60B differs from that of the first embodiment. The reinforcement part 60B is provided not to the air-conditioning case 11, and is provided to the outer side of the outer periphery part of the pair of tank parts 43B, 44.

The reinforcement part 60B is provided to the outer periphery part of the pair of tank parts 43B, 44 in the elastically deformed state to press the outer periphery part of the tank parts 43B, 44 by the elastic deformation. In other words, the reinforcement part 60B locally holds the pair of tank parts 43B, 44. Specifically, as shown in FIG. 13, the reinforcement part 60B has the U-shape cross-section, and the both end portions 71 of the reinforcement part 60B in the circumferential direction fittingly fix the side surface 72 of the upper tank part 43B therebetween. The reinforcement part 60B presses the side surface 72 of the upper tank part 43B inward. In other words, in case where external force is not added to the reinforcement part 60B, the interval between the both end portions 71 in the circumferential direction is smaller than the width of the upper tank part 43B. The reinforcement part 60B is elastically deformed, and is provided to the upper tank part 43B in this state where the interval between the both end portions 71 is expanded. Therefore, the restoring force is generated to return to the natural state in the both end portions 71, such that the side surface 72 of the upper tank part 43B is fixed in the pressed state. The reinforcement part 60B may be configured by spring steel, for example. The upper tank part 43B is not deformed by the pressing force of the reinforcement part 60B, and the pressing force of the reinforcement part 60B is set in a manner that the reinforcement part 60B is not removed while the vehicle receives vibration in the driving time.

The reinforcement part 60B is placed at the position of the antinode similarly to the first embodiment. Therefore, the reinforcement part 60B can directly suppress vibration generated at the position of antinode by the pressing force (restoring force). The evaporator 21 is configured in the state where the reinforcement part 60B is attached to the pair of tank parts 43B, 44. Similarly to the first embodiment, the gasket 61 is bonded to the outer periphery part of the pair of tank parts 43B, 44, and the evaporator is assembled to the air-conditioning case 11. The vibration propagation to the air-conditioning case 11 from the evaporator 21 can be controlled also with the gasket 61. As shown in FIG. 14, a comparative example is shown in a dashed line, the embodiment is shown in a thick solid line, and a back ground noise is shown in a thin solid line. The back ground noise is a sound pressure level when refrigerant is not flowing in the evaporator 21. In the embodiment, the reinforcement part 60B is formed at the position of the antinode of each tank part 43B, 44 as mentioned above. In the comparative example, the reinforcement part 60B is not provided. As shown in FIG. 14, the sound pressure level is smaller in the embodiment in the range from 4 kHz to 8 kHz. The range of 4 kHz to 8 kHz overlaps with the range (4 kHz to 10 kHz) of the sound emitted directly from the evaporator 21. Therefore, the reinforcement part 60B effectively restricts the vibration.

Thus, in this embodiment, the evaporator 21 is configured to include the reinforcement part 60B, and the reinforcement part 60B is formed at the position of antinode, thereby restricting the sound emitted directly from the evaporator 21. Compared with a case where isobutylene-isoprene rubber is prepared throughout the outer periphery part of the pair of tank parts 43B, 44, the mass effect can be set to, for example, one sixth (180 g of isobutylene-isoprene rubber to 30 g of spring steel) by using the reinforcement part 60B made of spring steel. Thus, vibration can be controlled while the weight can be reduced. Moreover, the pressing force for reducing the vibration of the pair of tank parts 43B, 44 may be individually designed based on specification and measurement result of each tank part 43B, 44.

(Other Embodiment)

The present disclosure may be variously modified and practiced within the scope of the present disclosure without being restricted to the embodiment, while the desirable embodiment of the present disclosure is described.

The scope of the present disclosure is not limited to the structure in the above-mentioned embodiment that is an aspect of the present disclosure. The scope of the present disclosure is shown by the appended claims, and also includes the equivalents of the claims within all the modifications.

The separator 47 and the choke portion 49 are disposed in the pair of tank parts 43, 44 as an inner wall part for changing refrigerant flow in the first embodiment. However, the pair of tank parts 43, 44 may not have an inner wall. The same action and effect are attained by forming the reinforcement part 60 at the position of antinode or a part of the air-conditioning case 11 opposing the antinode.

The evaporator 21 is applied to the air-conditioner 10 for a vehicle in the first embodiment. The evaporator 21 may be applied to an air-conditioner for home use, not restricted to the vehicle. The heat exchanger is not restricted to the evaporator 21, and may be a radiator or condenser while the heat exchanger has the rectangular parallelepiped shape through which refrigerant flows.

The reinforcement part 60 is formed to the air-conditioning case 11 and the reinforcement part 60 is not formed to the evaporator 21 in the first embodiment. The evaporator 21 having the reinforcement part 60B of the third embodiment may be mounted to the air-conditioning case 11 of the first embodiment. In this case, the rigidity can be raised at the position corresponding to the antinode, and the vibration control effect can be heightened.

The reinforcement part 60B is elastically deformed in the third embodiment. Alternatively, the rib 60 for reinforcement may be formed at the outer periphery part of the upper tank part 43 and the lower tank part 44, to raise the rigidity. The reinforcement part 60 may be integrally formed with the pair of tank parts 43, 44 without being limited to the detachable configuration.

What is claimed is:

1. A heat exchanger comprising:

a core part having a plurality of tubes in which refrigerant flows;

a pair of tank parts extending in an intersection direction to intersect the tubes at longitudinal ends of the tubes to distribute fluid to the tubes and to gather fluid flowing inside the tubes;

an inner wall part arranged in the pair of tank parts to change a flow of the refrigerant in the tank parts;

a reinforcement part that partially reinforces an outer periphery part of the pair of tank parts from outer side; and a protruding rib extending inwardly from an inner surface of the reinforcement part and engaging the outer periphery part of the pair of tank parts, so as to space the inner surface of the reinforcement part from the outer periphery part of the tank parts, wherein the reinforcement part is located at a position not overlapping with both ends of the pair of tank parts in the intersection direction and not overlapping with the inner wall part.

2. The heat exchanger according to claim 1, wherein the reinforcement part is located at least at a position not overlapping with both ends of the pair of tank parts in the intersection direction, and the position corresponds to an antinode of a vibration mode of the pair of tank parts.

3. The heat exchanger according to claim 1, wherein the reinforcement part is located at a center between the inner wall part and both ends of the pair of tank parts in the intersection direction which are adjacent to each other in the intersection direction.

4. The heat exchanger according to claim 1, wherein the reinforcement part is provided to the outer periphery part of the pair of tank parts in an elastically deformed state to press the outer periphery part of the tank parts.

5. An air conditioning device comprising:

an air-conditioning case through which air passes; and a heat exchanger arranged in the air-conditioning case, wherein the heat exchanger includes a core part having a plurality of tubes in which refrigerant flows, a pair of tank parts extending in an intersection direction to intersect the tubes at longitudinal ends of the tubes to distribute fluid to the tubes and to gather fluid flowing inside the tubes, and an inner wall part arranged in the pair of tank parts to change a flow of the refrigerant in the tank parts, the air-conditioning case includes a reinforcement part that partially reinforces the air-conditioning case, the air-conditioning case is in contact with an outer periphery part of the pair of tank parts to fix the heat exchanger, a protruding rib extends inwardly from an inner surface of the reinforcement part and engages the outer periphery part of the pair of tank parts, so as to space the inner surface of the reinforcement part from the outer periphery part of the tank parts, and the reinforcement part is located at a position not overlapping with both ends of the pair of tank parts in the intersection direction and not overlapping with the inner wall part.

6. The air conditioning device according to claim 5, wherein the reinforcement part is located at the position not overlapping with both ends of the pair of tank parts in the intersection direction, and the position corresponds to an antinode of a vibration mode of the pair of tank parts.

7. The air conditioning device according to claim 5, wherein the reinforcement part is located at a center between the inner wall part and both ends of the pair of tank parts in the intersection direction which are adjacent to each other in the intersection direction.

8. The air conditioning device according to claim 5, wherein the reinforcement part is provided to the air-conditioning case to extend in a direction parallel to the intersection direction and intersecting a longitudinal direction of the tube.

* * * * *